US010927464B2

(12) United States Patent
Kim et al.

(10) Patent No.: US 10,927,464 B2
(45) Date of Patent: Feb. 23, 2021

(54) CARBON FIBER TEXTILE REINFORCING MEMBER WITH ANODIC METAL LINE AND METHOD OF REPAIRING AND REINFORCING CONCRETE STRUCTURE USING THE SAME

(71) Applicant: KOREA INSTITUTE OF CIVIL ENGINEERING AND BUILDING TECHNOLOGY, Gyeonggi-Do (KR)

(72) Inventors: Hyeong Yeol Kim, Gyeonggi-do (KR); Gum Sung Ryu, Gyeonggi-do (KR); Dong Woo Seo, Gyeonggi-do (KR); Young Jun You, Gyeonggi-do (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 476 days.

(21) Appl. No.: 15/842,900

(22) Filed: Dec. 15, 2017

(65) Prior Publication Data

US 2019/0136389 A1 May 9, 2019

(30) Foreign Application Priority Data

Nov. 3, 2017 (KR) ..... 10-2017-0146082

(51) Int. Cl.
*C23F 13/14* (2006.01)
*C23F 13/18* (2006.01)
(Continued)

(52) U.S. Cl.
CPC ..... *C23F 13/14* (2013.01); *C23F 13/02* (2013.01); *C23F 13/10* (2013.01); *C23F 13/18* (2013.01);
(Continued)

(58) Field of Classification Search
CPC ..... C23F 13/02; C23F 2201/02
See application file for complete search history.

(56) References Cited

U.S. PATENT DOCUMENTS 6,383,364 B1 * 5/2002 Austnes ..... C04B 41/4566 205/734
6,398,945 B1 6/2002 Henriksen
2004/0011669 A1 * 1/2004 Glass ..... C23F 13/18 205/766

FOREIGN PATENT DOCUMENTS

JP 2007039996 A * 2/2007
JP 2010222653 10/2010
(Continued)

OTHER PUBLICATIONS

Machine translation of JP 2007-039996A (Year: 2007).*

*Primary Examiner* — Brian W Cohen
(74) *Attorney, Agent, or Firm* — JCIPRNET

(57) ABSTRACT

Provided are a carbon fiber textile reinforcing material with an anode metal line which can be repaired and reinforced with a high stiffness and non-corrosive carbon fiber textile by disposing a carbon fiber textile reinforcing material with an anodic metal line functioning as a conductor and a reinforcing material on a deteriorated cross-section of concrete, can maximize repair and reinforcement of a reinforced concrete structure by preventing additional corrosion of a concrete embedded reinforcing bar using a sacrificial anode arranged on the carbon fiber textile, can prevent corrosion of an existing reinforced concrete structure and can be used as a reinforcing material and a corrosion preventing material of a new concrete structure, and a method for repairing and reinforcing a reinforced concrete structure using the same.

6 Claims, 13 Drawing Sheets

(51) Int. Cl.

| | |
|---|---|
| ***C23F 13/10*** | (2006.01) |
| ***C23F 13/22*** | (2006.01) |
| ***C23F 13/02*** | (2006.01) |
| ***E04C 5/07*** | (2006.01) |

(52) U.S. Cl.
CPC ..... *C23F 13/22* (2013.01); *E04C 5/07* (2013.01); *E04C 5/073* (2013.01); *C23F 2201/02* (2013.01)

(56) References Cited

FOREIGN PATENT DOCUMENTS

| | | |
|---|---|---|
| JP | 2017128769 | 7/2017 |
| KR | 1020030088807 | 11/2003 |
| KR | 1020050101676 | 10/2005 |
| KR | 20130045483 | 5/2013 |
| KR | 101327241 | 11/2013 |
| KR | 20160138962 | 12/2016 |

* cited by examiner

[FIG. 1A]
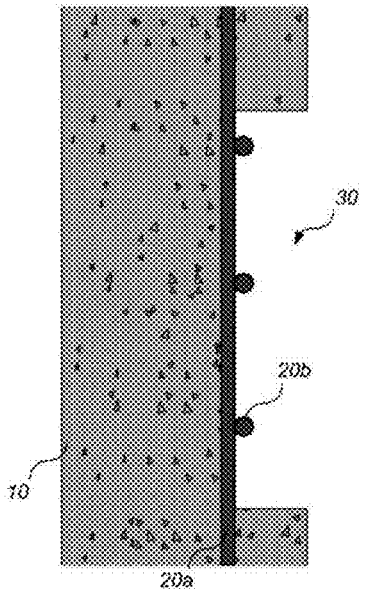
[FIG. 1B]
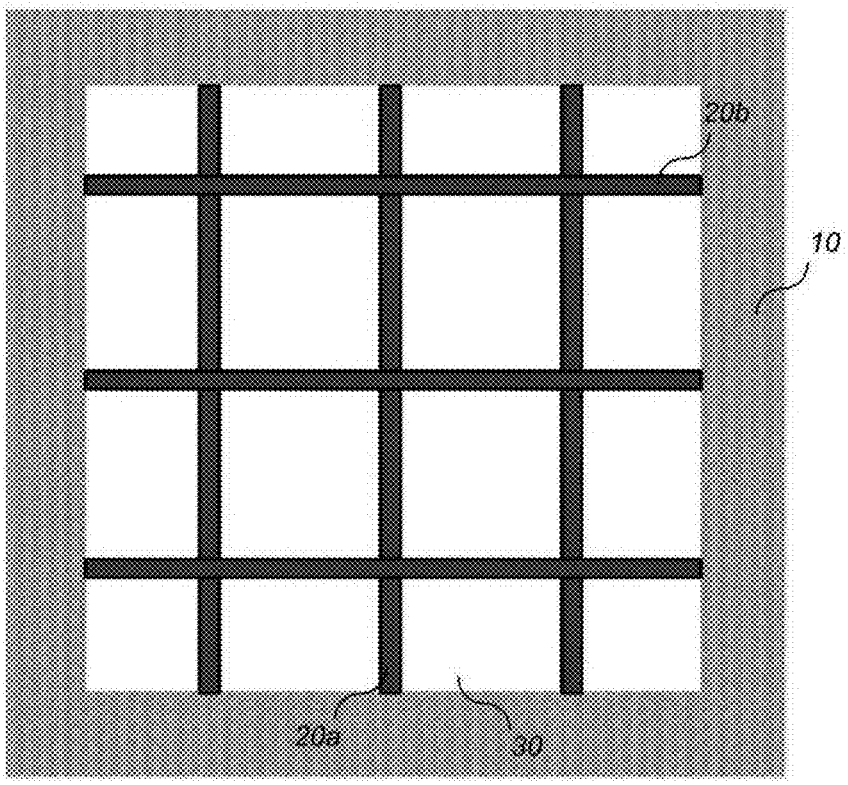

[FIG. 2]
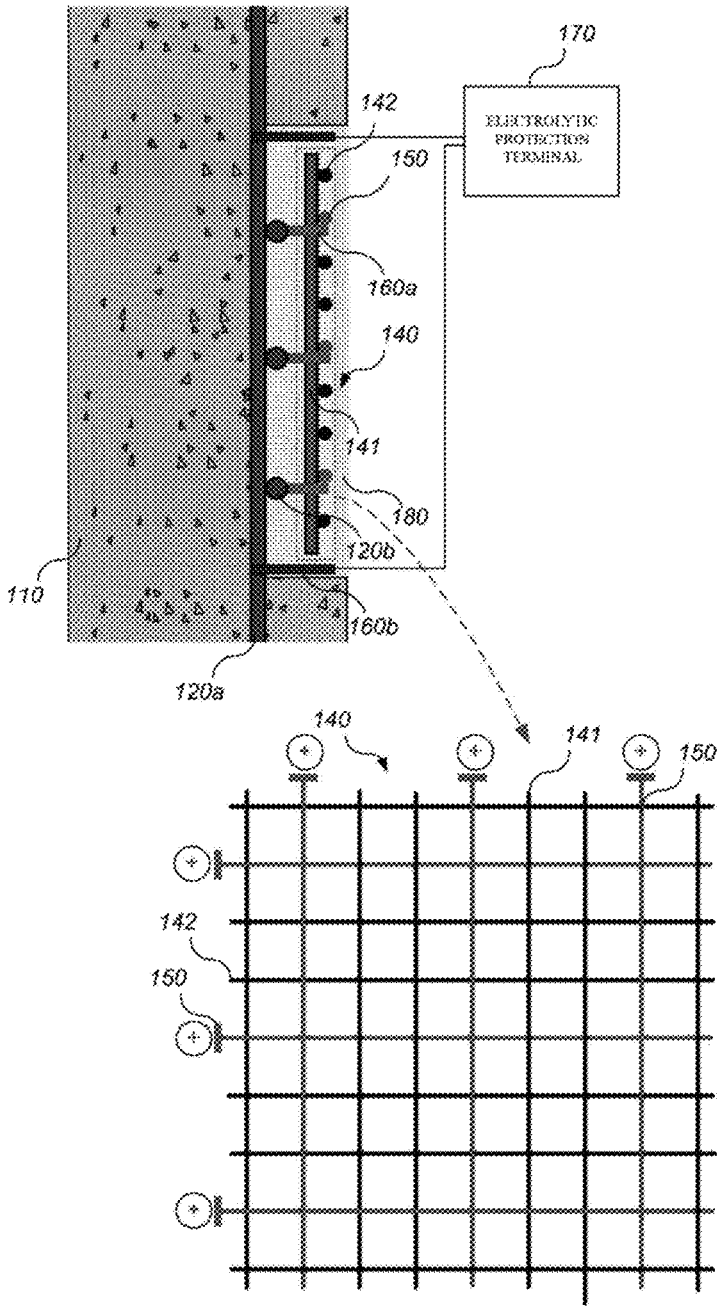

[FIG. 3A]
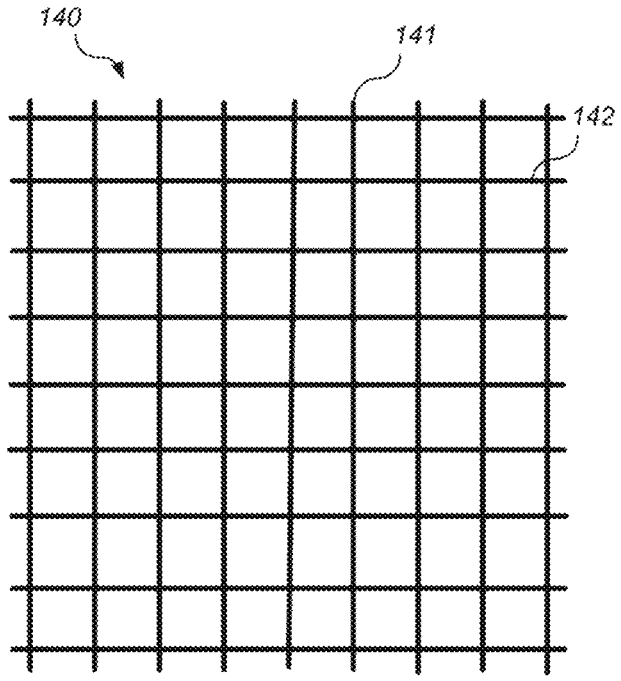
[FIG. 3B]
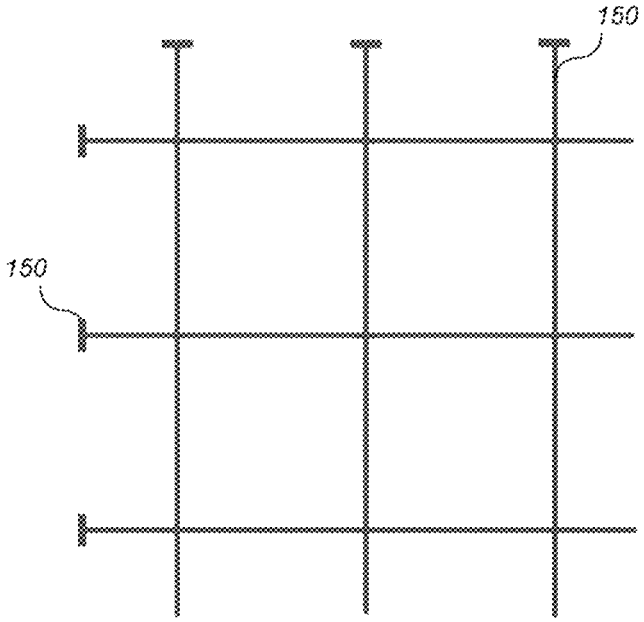

[FIG. 3C]
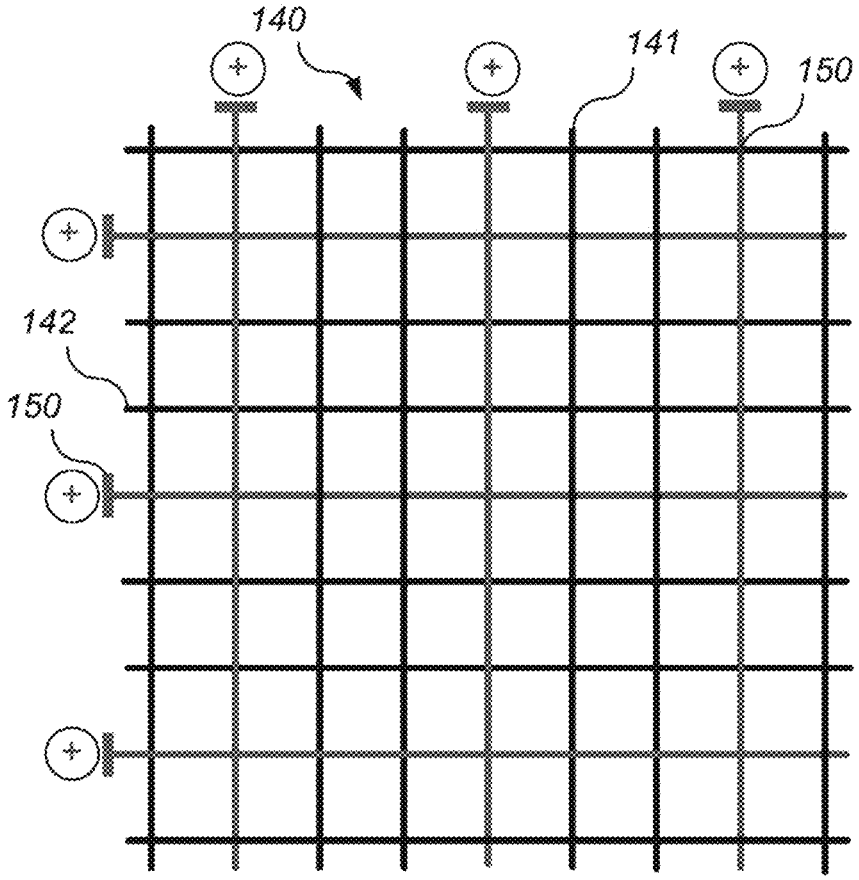

[FIG. 4]
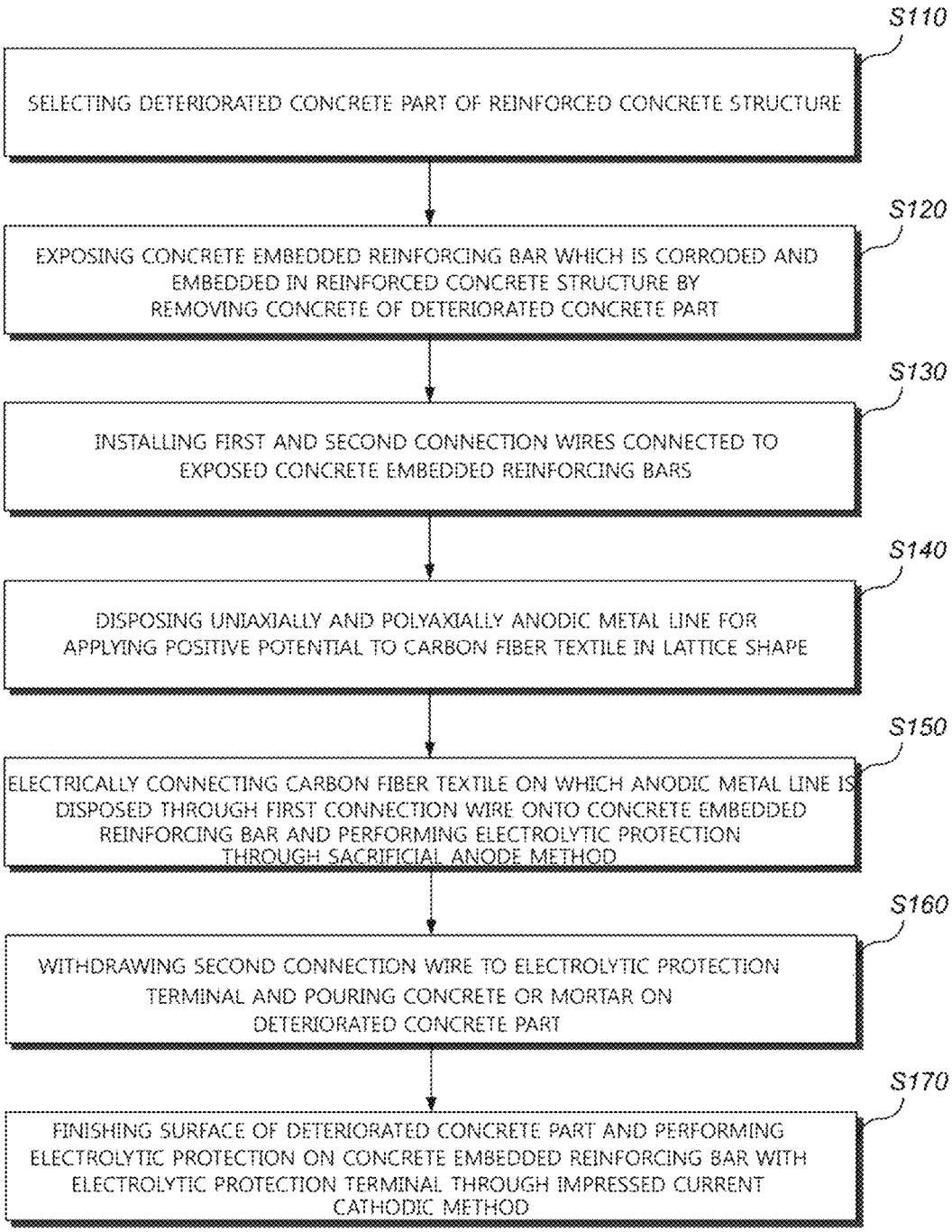

[FIG. 5A]
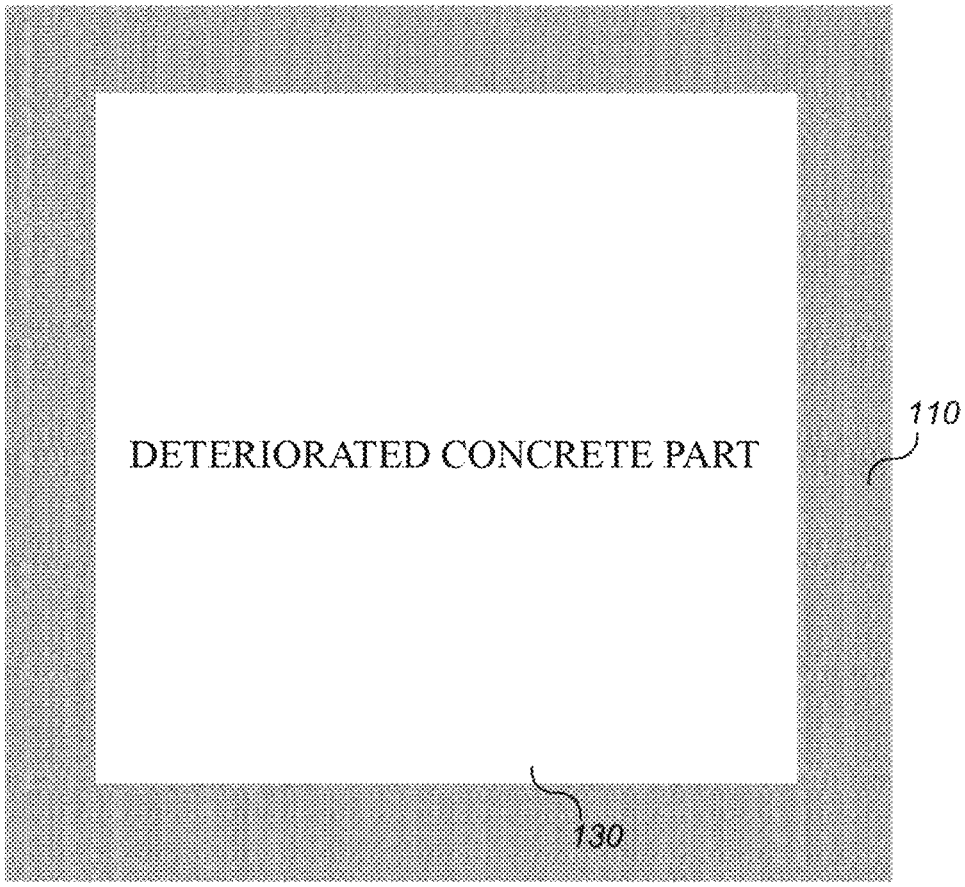

[FIG. 5B]
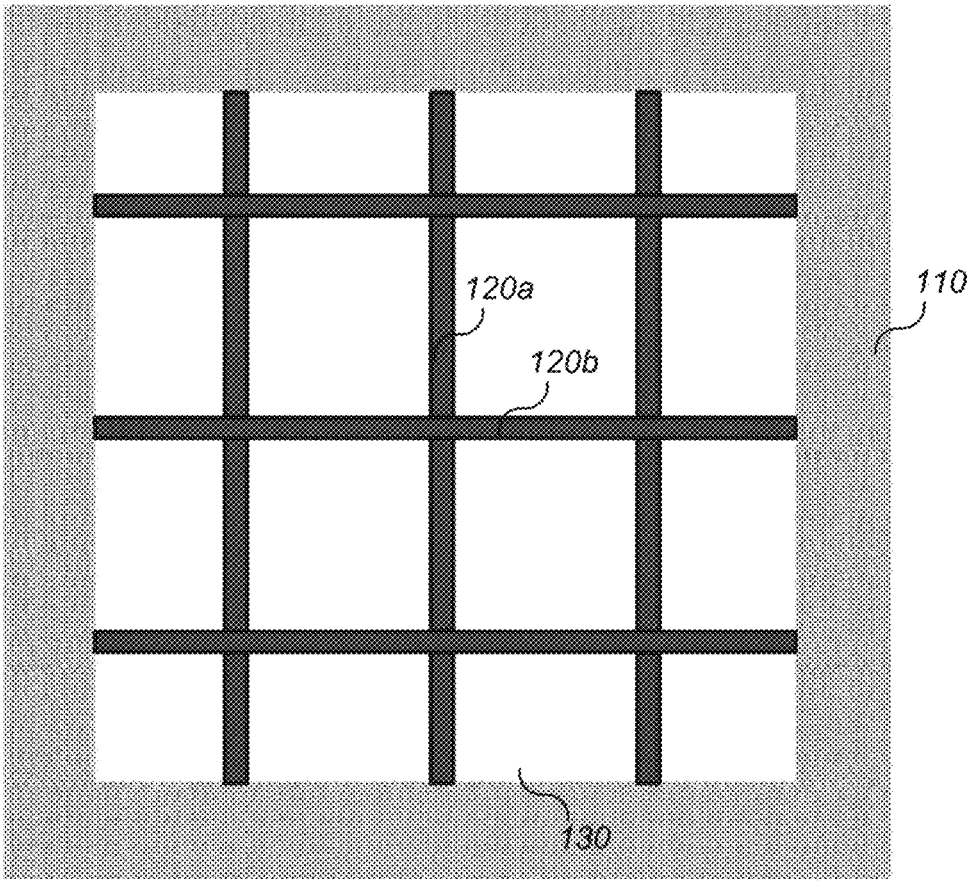

[FIG. 5C]
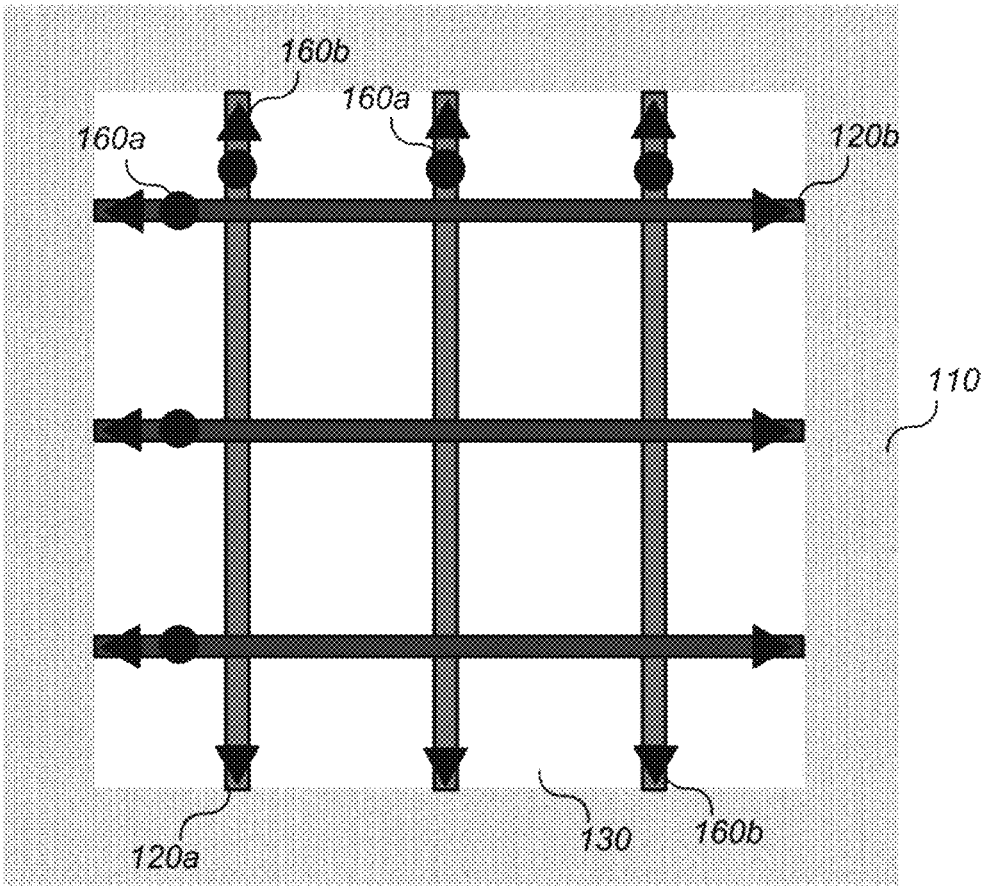

[FIG. 5D]
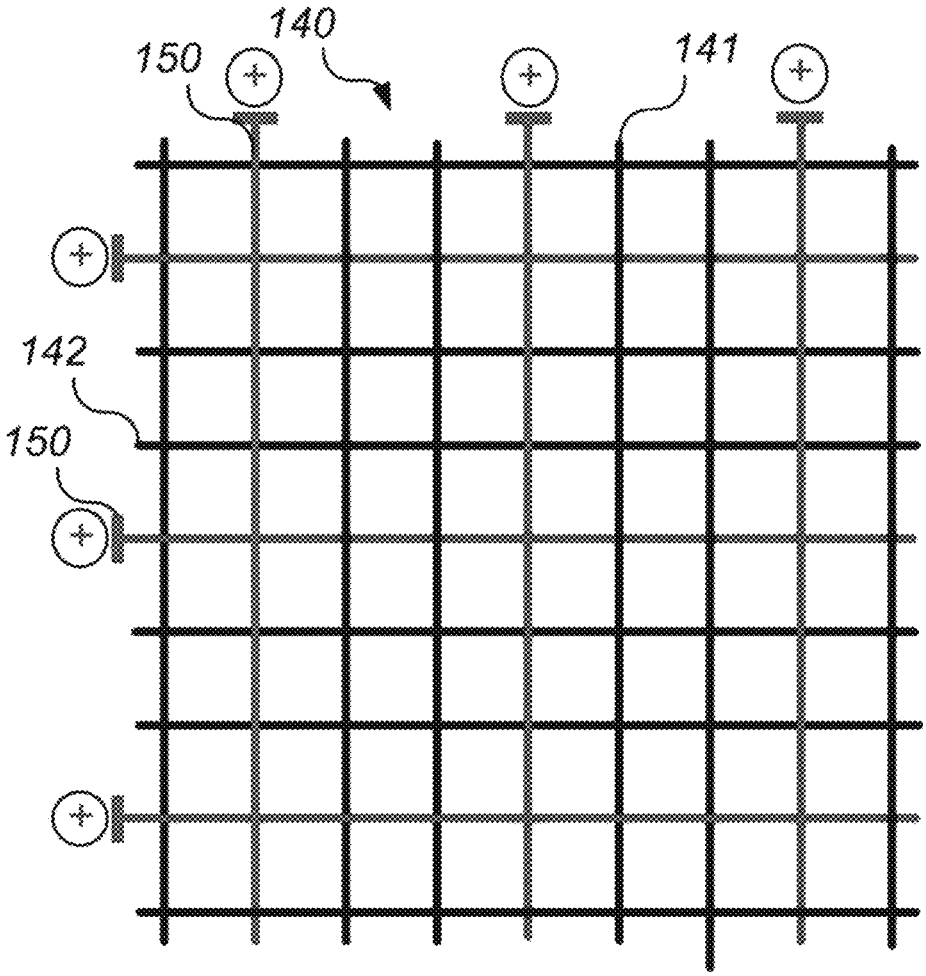

[FIG. 5E]
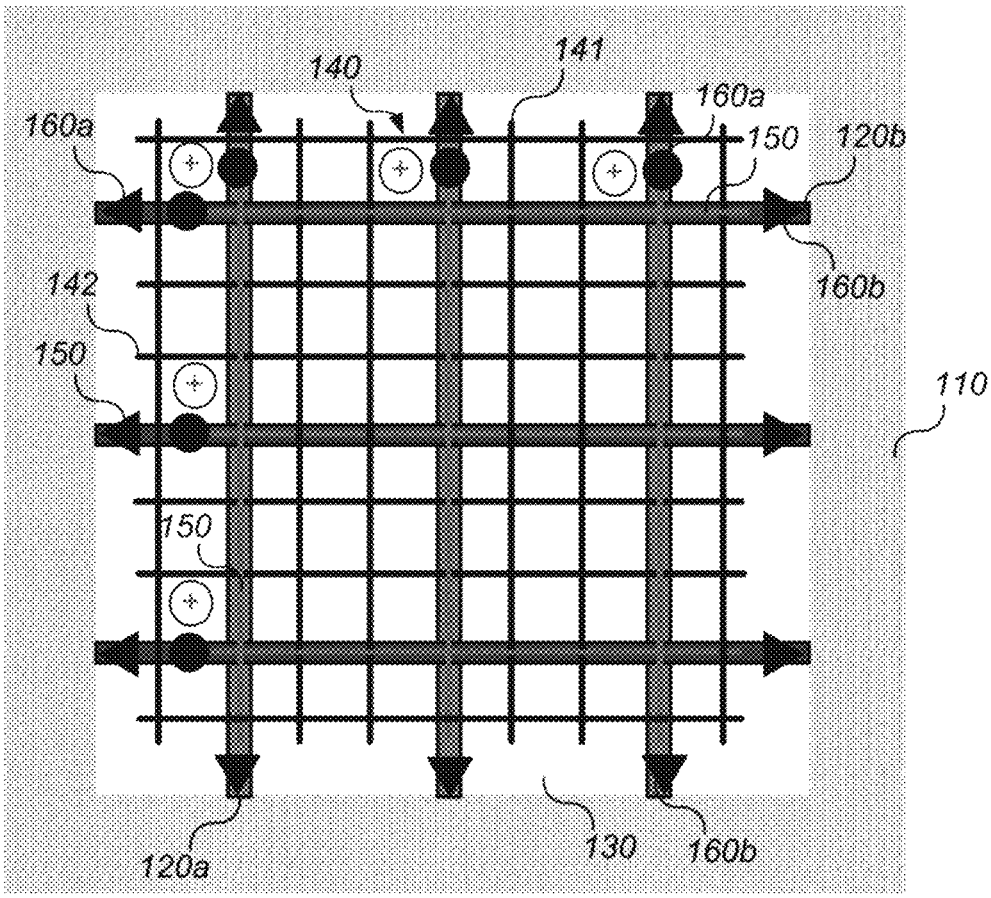

[FIG. 5F]
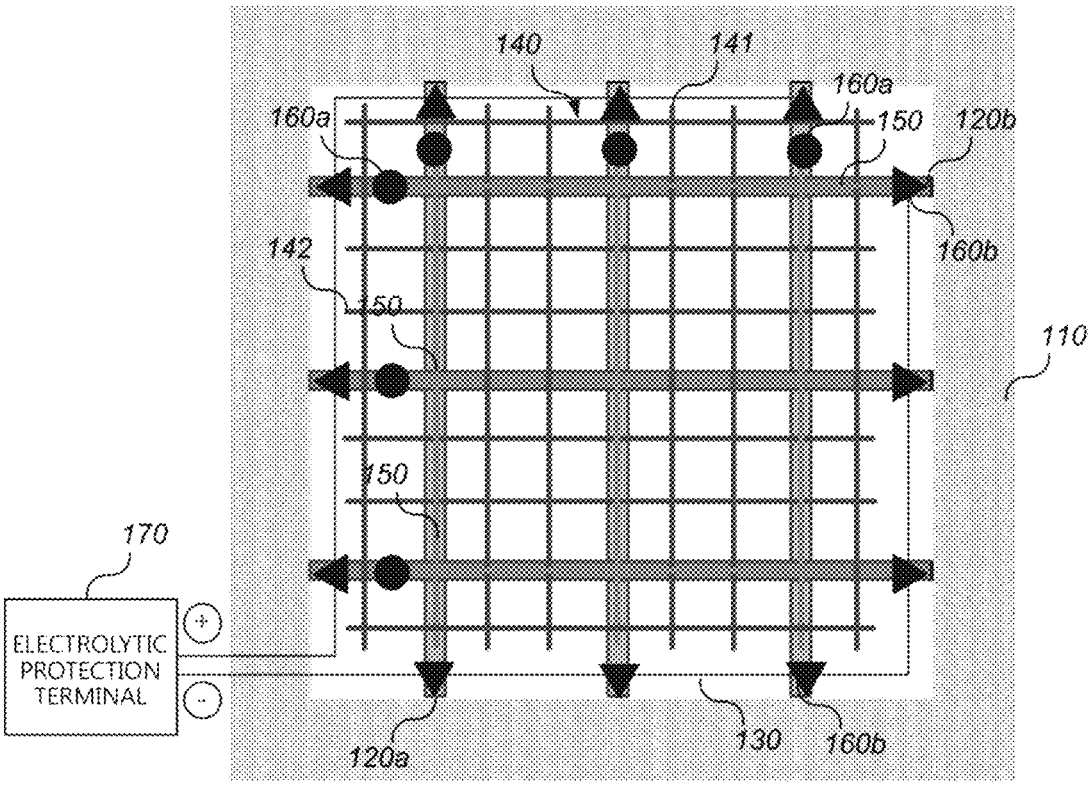

[FIG. 5G]
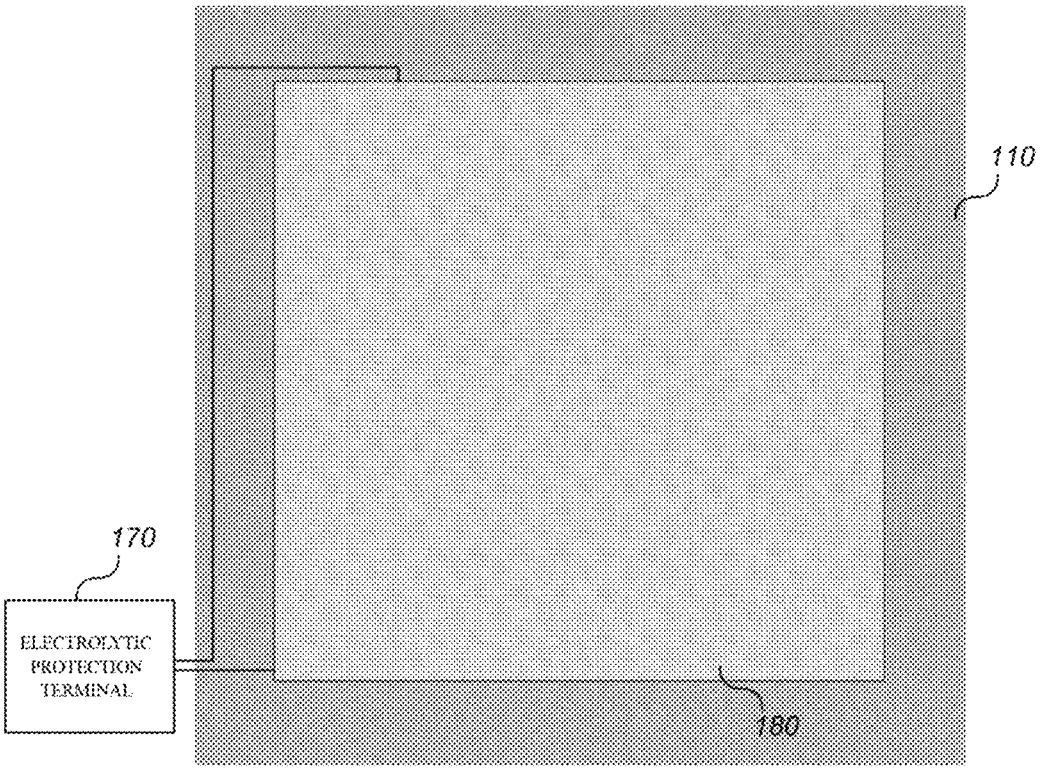

[FIG. 6A]
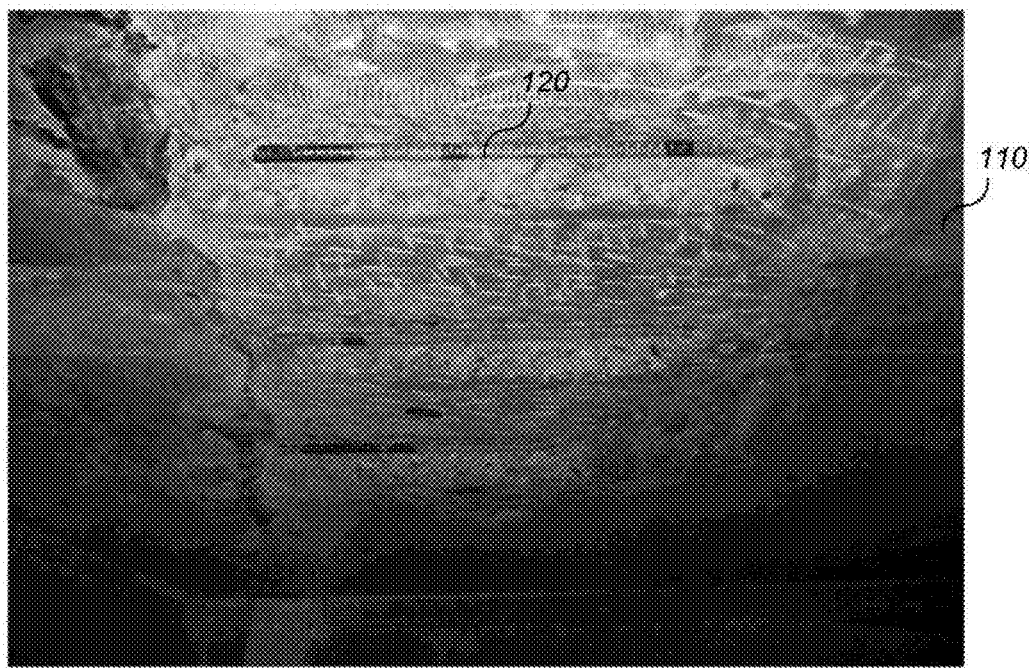
[FIG. 6B]
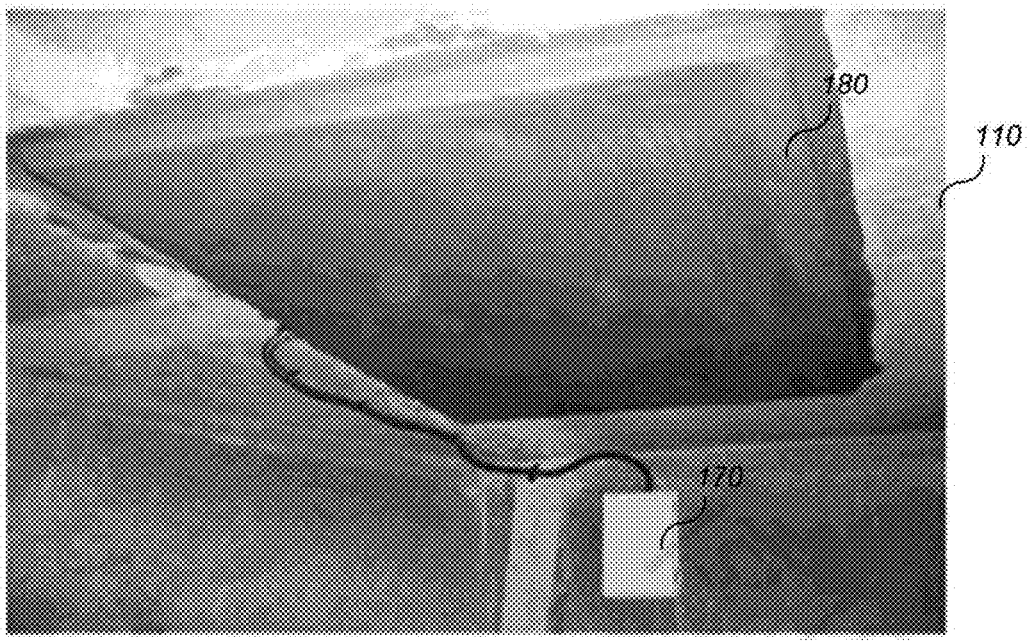

CARBON FIBER TEXTILE REINFORCING MEMBER WITH ANODIC METAL LINE AND METHOD OF REPAIRING AND REINFORCING CONCRETE STRUCTURE USING THE SAME

CROSS-REFERENCE TO RELATED APPLICATION

This application claims priority to and the benefit of Korean Patent Application No. 2017-0146082, filed on Nov. 3, 2017, the disclosure of which is incorporated herein by reference in its entirety.

BACKGROUND

1. Field of the Invention

The present invention relates to maintenance and repair of a reinforced concrete structure and, more specifically, to a carbon fiber textile reinforcing member with an anodic metal line which functions as a conductor for electrolytic protection and functions as a reinforcing material for reinforcing the reinforced concrete structure when a corroded reinforcing bar embedded in the reinforced concrete structure is repaired and reinforced, and a method of repairing and reinforcing a reinforced concrete structure using the same.

2. Discussion of Related Art

Reinforced concrete, which is widely used for a building and civil engineering structure, is an economical structural material with excellent durability. Generally, the reinforced concrete has been known to have about half a century of service life without special maintenance.

Actually, reinforced concrete, in which concrete and a reinforcing bar are combined, has been known as a composite material with an optimized function in a view of not only long term durability but also mechanical stiffness. However, according to various research results and recently performed site research, the reinforced concrete has a deteriorated durability due to corrosion of a reinforcing bar, and thus a serious problem is caused throughout a structure.

A major factor in durability deterioration of a reinforced concrete structure is corrosion of an embedded steel reinforcing bar, and a major factor causing corrosion of the embedded steel reinforcing bar is penetration of a chlorine ion and carbon oxide thereto. When the steel reinforcing bar is corroded, a corrosion product is formed on a surface of the embedded steel reinforcing bar and causes cracking and delamination of concrete, and the cracking and the delamination allow an external harmful element to penetrate the concrete to accelerate the corrosion of the steel reinforcing bar.

Therefore, safety and durability of the reinforced concrete structure is remarkably deteriorated, and the structure may collapse in severe cases. Also, when the reinforced concrete structure is already damaged, strengthening and repair tasks are very difficult and limited and have a large economic cost.

Specifically, deterioration of a reinforced concrete structure is affected by quality of used concrete and reinforcing bar, an environmental factor, a physical factor, and the like, particularly, by corrosion of a steel reinforcing bar embedded in the concrete. Particularly, when the reinforced concrete structure is located in an ocean, salinity in seawater penetrates into the concrete, or calcium chloride used for the purpose of melting snow on a winter road penetrates into the concrete, and the steel reinforcing bar embedded in the concrete is easily corroded, and thus the corroded reinforcing bar expands and generates fine cracks on the concrete.

The formed fine cracks extend to a surface of the concrete, and external air or water penetrates into the concrete through the cracks extending to the surface to further facilitate delamination and detachment of the concrete and corrosion of an inner reinforcing bar. Further, the salinity that penetrates into the concrete reacts with calcium hydroxide with a high alkaline component of 12 to 13 pH in the concrete to generate calcium carbonate and neutralize the concrete.

Therefore, various methods for preventing corrosion of a reinforcing bar embedded in concrete in a reinforced concrete structure and recovering a cross-section of detached concrete have been developed. One of the methods is to recover a cross-section of delaminated concrete with mortar for repair. However, when the cross-section is repaired through this method, salinity in the concrete is not completely removed, and thus there is a problem in that a repaired portion is easily delaminated due to corrosion of a reinforcing bar.

Further, electrolytic protection, which suppresses the advance of corrosion of a steel material by allowing a current to flow to the steel material, such as a reinforcing bar in concrete, from an electrode (an anode) positioned around a surface of the concrete to lower an electric potential of the steel material to an electric potential at which corrosion is not caused, is known as another method. The electrolytic protection includes impressed current cathodic protection and sacrificial anode protection.

The impressed current cathodic protection is referred to as cathodic protection in which an electric circuit formed by allowing a positive electrode of a direct current power supply to come into contact with an anode for corrosion prevention by a conductor and a negative electrode to come into contact with a steel material of a corrosion-prevented object by a conductor allows a corrosion prevention current to flow from an anode for corrosion prevention to the steel material. In the impressed current cathodic protection, an anode for corrosion prevention with high corrosion-resistance, such as a titanium mesh, a titanium grid, a titanium rod, and the like, is installed directly on a surface of the concrete or in a groove or a hole formed on the surface and is fixed by mortar. Therefore, there are problems in that it is disadvantageous in terms of cost due to an expensive anode with high corrosion-resistance and construction is complicated.

Meanwhile, FIG. 1 is a view showing a corroded concrete embedded reinforcing bar of a reinforced concrete structure according to a related art, wherein FIG. 1A is a vertical cross-section thereof, and FIG. 1B is a front view thereof.

As shown in FIGS. 1A and 1B, a corroded reinforced concrete structure 10 according to the related art is repaired by removing rust generated on a deteriorated cross-section thereof and concrete embedded reinforcing bars 20*a* and 20*b*, performing rust-proofing thereon, and pouring mortar or concrete thereon. However, cross-sectional damage of a deteriorated concrete part 30 is generated due to corrosion of the concrete embedded reinforcing bars 20*a* and 20*b*, and thus a reinforcing material should be additionally installed. Further, the rust-proofing of the concrete embedded reinforcing bars 20*a* and 20*b* is not thoroughly performed, and thus the corroded concrete embedded reinforcing bars 20*a* and 20*b* may be additionally corroded.

The electrolytic protection according to the related art has problems in that a lot of anodes are required and a concrete embedded reinforcing bar at a portion separated from the anode may be corroded because the anode is directly connected to an exposed concrete embedded reinforcing bar.

PRIOR ART DOCUMENTS

Patent Documents

Korean Laid-open Patent Application No. 2016-138962 (Published on Dec. 6. 2016) entitled "Cathode for Preventing Corrosion, and Concrete Structure Corrosion Prevention Structure and Corrosion Prevention Method Employing Same"

Korean Laid-open Patent Application No. 2013-45483 (Published on May 6. 2013), entitled "Structure with Anodic Application at Anode"

Korean Patent Registration No. 10-1327241 (Published on Nov. 4, 2013) entitled "Discrete Anode for Cathodic Protection of Reinforced Concrete"

Korean Laid-open Patent Application No. 2005-101676 (Published on Oct. 25, 2005), entitled "Sensor for Monitoring the Corrosion Damage of Steel Embedded in Concrete Structure and Sensor System"

Korean Laid-open Patent Application No. 2003-88807 (Published on Nov. 20, 2003), entitled "Cathodic Protection Repairing Method of Concrete Structures Using Zinc Sacrificial Anode and Mortar Composition for Coating Zinc Sacrificial Anode"

Japanese Patent Application Laid-Open No. 2010-222653 (published on Oct. 7, 2010) entitled "Reinforcement Corrosion Prevention Sheet of Concrete Structure and Method of Constructing Reinforcement Corrosion Prevention Sheet"

Japanese Patent Application Laid-Open No. 2017-128769 (published on Jul. 27, 2017) entitled "Galvanic Anode Unit and Electrolytic Protection Structure of Concrete Structure Using the Same"

SUMMARY OF THE INVENTION

The present invention is directed to a carbon fiber textile reinforcing material with an anodic metal line which is able to be repaired and reinforced with a high stiffness and non-corrosive carbon fiber textile by disposing the carbon fiber textile reinforcing material, which functions as a conductor and a reinforcing material, on a deteriorated cross-section of concrete, and a method of repairing and reinforcing a reinforced concrete structure using the same.

The present invention is directed to a carbon fiber textile reinforcing material with an anodic metal line which maximizes repair and reinforcement of a reinforced concrete structure by preventing additional corrosion of a concrete embedded reinforcing bar via a sacrificial anode arranged on the carbon fiber textile, and a method of repairing and reinforcing a reinforced concrete structure using the same.

According to an aspect of the present invention, there is provided a carbon fiber textile reinforcing material with an anodic metal line which includes concrete embedded reinforcing bars embedded in a reinforced concrete structure in transverse and longitudinal directions, respectively, and in which corrosion is caused, a carbon fiber textile disposed to reinforce a corresponding cross-section of a deteriorated concrete part of the reinforced concrete structure in a lattice shape and configured to function as a conductor, an anode metal line made of a metal with a natural electrode potential lower than that of the concrete embedded reinforcing bars and uniaxially or polyaxially disposed with the carbon fiber textile so that a positive potential is applied to the anode metal line, and a first connection wire configured to electrically connect the carbon fiber textile to one side of each of the concrete embedded reinforcing bars, wherein the carbon fiber textile is configured to be connected to the concrete embedded reinforcing bars to apply the positive potential applied through the anodic metal line to prevent corrosion of the concrete embedded reinforcing bars.

The carbon fiber textile may be made of a high stiffness and non-corrosive carbon fiber and may be configured to function as a conductor to supply a current to perform electrolyte protection of the concrete embedded reinforcing bars and as a reinforcing material reinforcing the deteriorated cross-section of the deteriorated concrete part.

The anodic metal line may not be directly connected to the concrete embedded reinforcing bars by a wire and may be connected thereto through the carbon fiber textile functioning as a conductor.

The corrosion of the concrete embedded reinforcing bars may be prevented through a sacrificial anode method, and the anodic metal line may be configured to function as an anode of the sacrificial anode method.

The anodic metal line may be manganese (Mg), aluminum (Al), or zinc (Zn) with a natural electrode potential lower than that of the concrete embedded reinforcing bars The carbon fiber textile reinforcing material may further include a second connection wire electrically connected to the other side of each of the concrete embedded reinforcing bars, wherein the second connection wire may be withdrawn to the outside through an electrolytic protection terminal and external power may be applied thereto to perform electrolytic protection through an impressed current cathodic protection method, and the corrosion of the concrete embedded reinforcing bars may be prevented through a sacrificial anode method first, and the external power may be supplied to the electrolytic protection terminal when the anode is completely consumed.

According to another aspect of the present invention, there is provided a method for repairing and strengthening a reinforced concrete structure using a carbon fiber textile reinforcing material with an anodic metal line which includes a) selecting a deteriorated concrete part of a reinforced concrete structure, b) exposing concrete embedded reinforcing bars, which are corroded reinforcing bars embedded in the reinforced concrete structure, by removing concrete of the deteriorated concrete part, c) installing first and second connection wires connected to the exposed concrete embedded reinforcing bars, d) disposing polyaxially or uniaxially an anodic metal line for applying a positive potential to a carbon fiber textile having a lattice shape, e) electrically connecting the carbon fiber textile on which the anodic metal line is disposed through the first connection wire onto the concrete embedded reinforcing bars and performing electrolytic protection through a sacrificial anode method, and f) withdrawing the second connection wire to an electrolytic protection terminal and pouring cement concrete or mortar on the deteriorated concrete part, wherein the carbon fiber textile 140 is connected to the concrete embedded reinforcing bars to apply the positive potential applied through the anodic metal line to the concrete embedded reinforcing bars to prevent corrosion of the concrete embedded reinforcing bars.

The method for repairing and reinforcing a reinforced concrete structure using a carbon fiber textile reinforcing material with an anodic metal line may further include g) finishing a surface of the deteriorated concrete part and performing electrolytic protection on the concrete embedded reinforcing bars through an impressed current cathodic protection with the electrolytic protection terminal, wherein the corrosion of the concrete embedded reinforcing bars may be prevented through the sacrificial anode method first and is then prevented by supplying external power to the electrolytic protection terminal when a sacrificial anode is completely consumed.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIGS. 1A and 1B are views showing a corroded concrete embedded reinforcing bar of a reinforced concrete structure according to a related art;

FIG. 2 is a view showing a carbon fiber textile reinforcing material with an anodic metal line according to one embodiment of the present invention;

FIGS. 3A to 3C are views showing a carbon fiber textile with an anodic metal line according to one embodiment of the present invention;

FIG. 4 is a flowchart of a method of reinforcing and repairing a reinforced concrete structure using a carbon fiber textile reinforcing material with an anodic metal line according to one embodiment of the present invention;

FIGS. 5A to 5G are views for specifically describing processes of preventing corrosion of a reinforced concrete structure using the carbon fiber textile reinforcing material with an anodic metal line according to one embodiment of the present invention; and FIGS. 6A and 6B are photographs showing a reinforced concrete structure processed by a method of repairing and reinforcing a reinforced concrete structure using the carbon fiber textile reinforcing material with an anodic metal line according to one embodiment of the present invention.

DETAILED DESCRIPTION OF EXEMPLARY EMBODIMENTS

Hereinafter, embodiments that are easily performed by those skilled in the art will be described in detail with reference to the accompanying drawings. However, embodiments of the present invention may be implemented in several different forms, and are not limited to embodiments described herein. In addition, parts irrelevant to description will be omitted in the drawings to clearly explain embodiments of the present invention. Similar parts are denoted by similar reference numerals throughout this specification.

Throughout the specification, when a portion "includes" an element, the portion may include the element and another element may be further included therein, unless otherwise described.

[Carbon Fiber Textile Reinforcing Material with Anodic Metal Line]

FIG. 2 is a view showing a carbon fiber textile reinforcing material with an anodic metal line according to one embodiment of the present invention, and FIGS. 3A-3C are views showing a carbon fiber textile with an anodic metal line according to one embodiment of the present invention.

Referring to FIG. 2, a carbon fiber textile reinforcing material with an anodic metal line according to one embodiment of the present invention includes concrete embedded reinforcing bars 120*a* and 120*b*, a carbon fiber textile 140, an anodic metal line 150, a first connection wire 160*a*, a second connection wire 160*b*, an electrolytic protection terminal box 170, and a repair concrete or mortar 180.

Each of the concrete embedded reinforcing bars 120*a* and 120*b* is embedded and arranged in a reinforced concrete structure 110 in a transverse direction and a longitudinal direction, and corrosion is caused. In this case, the concrete embedded reinforcing bars 120*a* and 120*b* may be a corroded longitudinal reinforcing bar 120*a* or a corroded transverse reinforcing bar 120*b*.

The carbon fiber textile 140 is made of a typically produced roving cross or is specially manufactured with a designed thickness and lattice distance of carbon fiber for its intended purpose, and the carbon fiber textile 140 is arranged in a lattice shape to reinforce a deteriorated cross-section of a deteriorated concrete part 130 of the reinforced concrete structure 110 and functions as a conductor. In this case, the carbon fiber textile 140 is connected to the concrete embedded reinforcing bars 120*a* and 120*b* to apply a positive potential applied through the anodic metal line 150 to the concrete embedded reinforcing bars 120*a* and 120*b*, and thus corrosion of the concrete embedded reinforcing bars 120*a* and 120*b* is prevented.

The anodic metal line 150 is made of a metal with a natural electrode potential lower than that of the concrete embedded reinforcing bars 120*a* and 120*b* and is polyaxially or uniaxially arranged on the carbon fiber textile 140, and a positive potential is applied to the anodic metal line 150. That is, the anodic metal line 150 is made of a metal with a natural electrode potential lower than that of the concrete embedded reinforcing bars 120*a* and 120*b*, such as Mg, Al, Zn, and the like, and is arranged on the carbon fiber textile 140, the carbon fiber textile 140 is directly connected to the concrete embedded reinforcing bars 120*a* and 120*b* or connected to the concrete embedded reinforcing bars 120*a* and 120*b* by a first connection wire 160*a*, and cement concrete or mortar 180 is poured, and thus corrosion of the concrete embedded reinforcing bars 120*a* and 120*b* can be fundamentally prevented. In this case, a thickness or the number of the anodic metal lines 150 is determined depending on a corrosion environment and corrosion prevention period of the target reinforced concrete structure 110.

Particularly, in the carbon fiber textile 140, as shown in FIG. 3A, a plurality of longitudinal carbon fibers 141 and transverse carbon fibers 142 are arranged in a lattice shape, the anodic metal line 150 shown in FIG. 3B is polyaxially or uniaxially arranged thereon, and the carbon fiber textile reinforcing material is formed, as shown in FIG. 3C.

The first connection wire 160*a* electrically connects the carbon fiber textile 140 to one side of each of the concrete embedded reinforcing bars 120*a* and 120*b*, and the second connection wire 160*b* is electrically connected with the other side of each of the concrete embedded reinforcing bars 120*a* and 120*b* and is exposed to the outside to be connected to the electrolytic protection terminal box 170.

The electrolytic protection terminal box 170 is installed outside the reinforced concrete structure 110 and is connected to a wire withdrawn from the second connection wire 160*b* to perform electrolytic protection of the concrete embedded reinforcing bars 120*a* and 120*b*.

The concrete or mortar 180 is poured to the deteriorated concrete part 130 to embed the deteriorated concrete part 130 after the installation of the carbon fiber textile 140, the first connection wire 160*a*, and second connection wire 160*b*.

The carbon fiber textile reinforcing material with the anodic metal line of the present invention, as shown in FIG. 2, includes the carbon fiber textile 140 made with the longitudinal carbon fiber 141 and the transverse carbon fiber 142 disposed in a lattice shape and the anodic metal line 150 polyaxially or uniaxially disposed on the carbon fiber textile 140.

In this case, a cross-section of the deteriorated concrete part 130 is removed, the corroded concrete embedded reinforcing bars 120*a* and 120*b* are exposed, corrosion-proofing is performed thereon, and then the carbon fiber textile reinforcing material with an anodic metal line of the present invention is disposed at a cross-section of the deteriorated concrete part 130 to be repaired to reinforce cross-sectional damage of a reinforcing bar caused due to the corrosion of the concrete embedded reinforcing bars 120*a* and 120*b*, as shown in FIGS. 3A-3C. In this case, the concrete embedded reinforcing bars 120*a* and 120*b* are connected with the carbon fiber textile 140 by the first connection wire 160*a*, and the cross-section is repaired by the concrete or mortar 180 to complete the repair.

In the carbon fiber textile reinforcing material with the anodic metal line according to one embodiment of the present invention, the anodic metal line 150 is polyaxially or uniaxially disposed, and the carbon fiber textile 140, which is a reinforcing material, is installed at a corresponding cross-section of the deteriorated concrete part 130 of the reinforced concrete structure 110, and thus, installation of an anode is completed. In this case, the carbon fiber textile 140 functions as a conductor, and thus it is not necessary for the anodic metal line 150 to be directly connected to the concrete embedded reinforcing bars 120*a* and 120*b* by a wire and the corrosion is prevented without installation of a lot of anodes.

In the carbon fiber textile reinforcing material with an anodic metal line according to one embodiment of the present invention, the first connection wire 160*a* directly connects the carbon fiber textile 140 with the concrete embedded reinforcing bars 120*a* and 120*b*, and thus corrosion is prevented via a sacrificial anode method by the anodic metal line 150 being used as a sacrificial anode and being provided in the carbon fiber textile 140. The second connection wire 160*b* is withdrawn from the carbon fiber textile 140 to the electrolytic protection terminal box 170 at the outside, and external power is supplied to perform corrosion prevention when the anodic metal line 150 used as the sacrificial anode is completely consumed.

Therefore, the carbon fiber textile reinforcing material with an anodic metal line functioning as a conductor and a reinforcing material according to one embodiment of the present invention is disposed at a cross-section of the deteriorated concrete, and thus repair and reinforcement are performed by a high strength and non-corrosive carbon fiber textile. Additional corrosion of the concrete embedded reinforcing bar is prevented by the sacrificial anode arranged in the carbon fiber textile, and the repair and reinforcement of the reinforced concrete structure is maximized. Further, the carbon fiber textile reinforcing material with an anodic metal line can prevent corrosion of an existing reinforced concrete structure and can also be used as a reinforcing bar and corrosion preventing material of a new concrete building.

[Method of Repairing and Reinforcing a Reinforced Concrete Structure Using a Carbon Fiber Textile Reinforcing Material with an Anodic Metal Line]

FIG. 4 is a flowchart of a method of reinforcing and repairing a reinforced concrete structure using a carbon fiber textile reinforcing material with an anodic metal line according to one embodiment of the present invention, and FIGS. 5A to 5G are views for specifically describing processes of preventing corrosion of a reinforced concrete structure using the carbon fiber textile reinforcing material with an anodic metal line according to one embodiment of the present invention Referring to FIG. 4 and FIGS. 5A to 5G, the method of repairing and reinforcing a reinforced concrete structure using a carbon fiber textile reinforcing material with an anodic metal line according to one embodiment of the present invention includes, as shown in FIG. 5A, selecting a deteriorated concrete part 130 of a reinforced concrete structure 110 (S110). In this case, site research on the reinforced concrete structure 110 to be repaired and reinforced is performed, and thus a portion at which concrete is delaminated or detached is determined.

As shown in FIG. 5B, concrete of the deteriorated concrete part 130 is removed to expose concrete embedded reinforcing bars 120*a* and 120*b*, which are corroded reinforcing bars embedded in the reinforced concrete structure 110 (S120). In this case, concrete of the deteriorated concrete part 130 to be delaminated due to deterioration or detached due to severe cracking around a portion at which the reinforced concrete structure 110 is detached is removed, a corroded portion of the concrete embedded reinforcing bars 120*a* and 120*b* exposed from the deteriorated concrete part 130 is preferably removed by sandpaper, a brush, and the like, and the concrete embedded reinforcing bars 120*a* and 120*b* from which the corroded portion is removed are washed with water, dried, and a rust inhibitor is applied thereto when necessary.

As shown in FIG. 5C, first and second connection wires 160*a* and 160*b* each connected to the exposed concrete embedded reinforcing bars 120*a* and 120*b* are installed (S130).

As shown in FIG. 5D, an anodic metal line 150 for applying a positive potential is polyaxially or uniaxially disposed on a latticed carbon fiber textile 140 (S140).

As shown in FIG. 5E, electrolytic protection is performed through a sacrificial anode method by electrically connecting the carbon fiber textile 140 on which the anodic metal line 150 is disposed to the concrete embedded reinforcing bars 120*a* and 120*b* through the first connection wire 160*a* (S150). In this case, electrolytic protection is performed on the concrete embedded reinforcing bars 120*a* and 120*b* through the sacrificial anode method, and the anodic metal line 150 function as an anode of the sacrificial anode method. The anodic metal line 150 may be manganese (Mg), aluminum (Al), or zinc (Zn) with a natural electrode potential lower than that of the concrete embedded reinforcing bars 120*a* and 120*b*. Further, the anodic metal line 150 and the concrete embedded reinforcing bars 120*a* and 120*b* are not directly connected by a wire but are connected through the carbon fiber textile 140 functioning as a conductor.

As shown in FIG. 5F, the second connection wire 160*b* is withdrawn to a electrolytic protection terminal box 170, and cement concrete or mortar 180 is poured on the deteriorated concrete part 130 (S160).

As shown in FIG. 5G, a surface of the deteriorated concrete part 130 is finished, and electrolytic protection is performed through impressed current cathodic protection with respect to the concrete embedded reinforcing bars 120*a* and 120*b* through the electrolytic protection terminal box 170 (S170). Therefore, electrolytic protection is performed on the concrete embedded reinforcing bars 120*a* and 120*b* through the sacrificial anode method first, and external power is supplied to the electrolytic protection terminal box 170 when the sacrificial anode is completely consumed to preform corrosion prevention.

Therefore, the carbon fiber textile 140 is connected to the concrete embedded reinforcing bars 120*a* and 120*b* to apply a positive potential applied through the anodic metal line 150 to the concrete embedded reinforcing bars 120*a* and 120*b*, and thus corrosion of the concrete embedded reinforcing bars 120*a* and 120*b* is prevented. In this case, the carbon fiber textile 140 is made of a high stiffness and non-corrosive carbon fiber to simultaneously function as a conductor supplying a current for electrolytic protection with respect to the concrete embedded reinforcing bars 120*a* and 120*b* and as a reinforcing material reinforcing a cross-section of the deteriorated concrete part 130.

Generally, electro-chemical protection of a reinforcing bar includes impressed current cathodic protection and the sacrificial anode method. The sacrificial anode method is a method of protecting a reinforcing bar, which is an object to be corroded, by connecting the reinforcing bar with a metal with an electric potential relatively lower than that of the reinforcing bar, which is an object to be corroded, to sacrificially corrode the metal.

Specifically, when a sacrificial anode, which is a metal with a natural electrode potential lower than that of the concrete embedded reinforcing bars 120*a* and 120*b*, such as manganese (Mg), aluminum (Al), zinc (Zn) or the like, is directly connected to the concrete embedded reinforcing bars 120*a* and 120*b* or connected thereto by a connection wire, a cell reaction is formed between the concrete embedded reinforcing bars 120*a* and 120*b* and the sacrificial anode, and a metal ion is eluted from the sacrificial anode with a low potential difference so that a corrosion prevention current flows to the concrete embedded reinforcing bars 120*a* and 120*b*, and thus corrosion of the concrete embedded reinforcing bars 120*a* and 120*b* is prevented, which is referred to as the sacrificial anode method for a electrolytic protection method.

In the carbon fiber textile reinforcing material with an anodic metal line according to one embodiment of the present invention, the anodic metal line 150 is uniaxially or polyaxially disposed on the carbon fiber textile 140, and the carbon fiber textile 140, which is a reinforcing material, is installed at the corresponding cross-section of the deteriorated concrete part 130 of the reinforced concrete structure 110, and thus installation of the anode is competed. The carbon fiber textile 140 functions as a conductor, and thus it is not necessary for the anode to be connected to the concrete embedded reinforcing bars 120*a* and 120*b* by a wire, and corrosion prevention is possible without many anodes being installed. In this case, the first connection wire 160*a* is connected, and then a current flows between the concrete embedded reinforcing bars 120*a* and 120*b*, which are conductors, and thus corrosion of the concrete embedded reinforcing bars 120*a* and 120*b* is prevented.

FIGS. 6A-6B are photographs showing a reinforced concrete structure processed by a method of repairing and reinforcing a reinforced concrete structure using the carbon fiber textile reinforcing material with an anodic metal line according to one embodiment of the present invention.

FIG. 6A shows that a corroded concrete embedded reinforcing bar 120 is exposed from a deteriorated concrete part of a reinforced concrete structure 110, and FIG. 6B is a photograph that shows that a surface of the deteriorated concrete part is finished by concrete or mortar 180 and a electrolytic protection terminal box 170 is exposed to the outside of the reinforced concrete structure 110, wherein the reinforced concrete structure 110 is processed by the method of repairing and reinforcing a reinforced concrete structure using a carbon fiber textile reinforcing material with an anode metal line according to one embodiment of the present invention.

The carbon fiber textile reinforcing material with an anode metal line according to one embodiment of the present invention may be applied to a reinforced concrete structure in civil engineering and building fields, and may be also applied to repair and reinforcement of an old reinforced concrete structure.

According to the present invention, the carbon fiber textile reinforcing material with an anodic metal line functioning as a conductor and a reinforcing material is disposed at a cross-section of concrete, and thus repair and reinforcement thereof can be performed with a high stiffness and non-corrosive carbon fiber textile.

According to the present invention, a sacrificial anode arranged in the carbon fiber textile prevents additional corrosion of a concrete embedded reinforcing bar to maximize repair and reinforcement of a reinforced concrete structure.

According to the present invention, the carbon fiber textile reinforcing material with an anodic metal line can prevent corrosion of an existing reinforced concrete structure and can be used as a reinforcing material and a corrosion preventing material of a new concrete structure.

The above description is only exemplary, and it should be understood by those skilled in the art that the invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims, and encompasses all modifications or alterations derived from meanings, the scope and equivalents of the appended claims.

What is claimed is:

1. A carbon fiber textile reinforcing material with an anodic metal line, the carbon fiber textile reinforcing material comprising:

concrete embedded reinforcing bars embedded in a reinforced concrete structure in transverse and longitudinal directions respectively, and in which corrosion is caused;

a carbon fiber textile disposed in a lattice shape and configured to function as a conductor;

an anode metal line made of a metal with a natural electrode potential lower than that of the concrete embedded reinforcing bars and uniaxially or polyaxially disposed on the carbon fiber textile so that a positive potential is applied to the anode metal line; and a first connection wire configured to electrically connect the carbon fiber textile to one side of each of the concrete embedded reinforcing bars, wherein the carbon fiber textile is configured to be connected to the concrete embedded reinforcing bars to apply the positive potential applied through the anodic metal line to the concrete embedded reinforcing bars to prevent the corrosion of the concrete embedded reinforcing bars, and to reinforce a corresponding cross-section of a deteriorated concrete part of the reinforced concrete structure.

2. The carbon fiber textile reinforcing material of claim 1, wherein the carbon fiber textile is made of a non-corrosive carbon fiber and is configured to simultaneously function as a conductor supplying a current to perform electrolyte protection of the concrete embedded reinforcing bars and as a reinforcing material reinforcing the corresponding cross-section of the deteriorated concrete part.

3. The carbon fiber textile reinforcing material of claim 2, wherein the anodic metal line is not directly connected to the concrete embedded reinforcing bars by a wire and is connected thereto through the carbon fiber textile functioning as a conductor.

4. The carbon fiber textile reinforcing material of claim 1, wherein the corrosion of the concrete embedded reinforcing bars is prevented through a sacrificial anode method, and the anodic metal line is configured to function as an anode of the sacrificial anode method.

5. The carbon fiber textile reinforcing material of claim 4, wherein the anodic metal line is manganese (Mn), aluminum (Al), or zinc (Zn) with a natural electrode potential lower than that of the concrete embedded reinforcing bars.

6. The carbon fiber textile reinforcing material of claim 1, further comprising a second connection wire electrically connected to the other side of each of the concrete embedded reinforcing bars, wherein the second connection wire is withdrawn to the outside through an electrolytic protection terminal box and external power is applied thereto to perform electrolytic protection through an impressed current cathodic protection method, and the corrosion of the concrete embedded reinforcing bars is prevented through a sacrificial anode method first, and the external power is supplied to the electrolytic protection terminal box to perform electrolytic protection when the anode is completely consumed.

* * * * *